US006878078B2

(12) United States Patent
Swanson

(10) Patent No.: US 6,878,078 B2
(45) Date of Patent: Apr. 12, 2005

(54) PADDED LEATHER PITCHING TARGET

(76) Inventor: Michael J. Swanson, 1311 SW. 328th Ct., Federal Way, WA (US) 98023

( * ) Notice: Subject to any disclaimer, the term of this patent is extended or adjusted under 35 U.S.C. 154(b) by 123 days.

(21) Appl. No.: 10/331,076

(22) Filed: Dec. 27, 2002

(65) Prior Publication Data

US 2004/0127308 A1 Jul. 1, 2004

(51) Int. Cl.[7] ..... A63B 69/40
(52) U.S. Cl. ..... 473/454; 473/435
(58) Field of Search ..... 473/451, 454, 473/456, 462; 273/404, 407, 408, 410

(56) References Cited

U.S. PATENT DOCUMENTS 4,275,883 A * 6/1981 Grimaldi et al. ..... 473/432
4,497,485 A * 2/1985 Macosko ..... 473/435
4,830,369 A * 5/1989 Poitras ..... 473/455
4,978,121 A * 12/1990 Larkey ..... 473/454
5,133,548 A * 7/1992 Bedord et al. ..... 473/436
5,354,066 A * 10/1994 Swanson et al. ..... 273/408
5,439,211 A * 8/1995 Drabowsky ..... 473/456
5,573,240 A * 11/1996 Humboldt ..... 473/454
5,803,842 A * 9/1998 Ross ..... 473/456

* cited by examiner

*Primary Examiner*—Stephen P. Garbe
*Assistant Examiner*—Nini F. Legesse

(57) ABSTRACT

A leather pitching target simulates the sound of a pitched ball hitting a catcher's mitt and forms a visual indentation where the ball strikes the target. An air-filled layer of padding may be sandwiched between a leather target sheet and a durable backing material. A square or rectangular quilted pattern of stitching may bind the layers together. A differently colored block U-shaped pattern of squares forms the inside, outside, and bottom of the strike zone. Each time the ball hits the target, pressure from the impact levels out the previous impression and creates a new one where the new pitch hit the target.

12 Claims, 2 Drawing Sheets

PADDED LEATHER PITCHING TARGET

BACKGROUND OF THE INVENTION

1. Field of the Invention

The present invention relates to baseball pitching targets and in particular to a padded leather pitching target which provides the sound of a ball being pitched into a catcher's mitt and also produces an indentation in the target where the ball hits for instant feedback on the accuracy and quality of the pitch both inside and outside of the strike zone.

2. Description of the Prior Art

Pitching is one of the most important aspects of the game of baseball. A good pitcher can win the game for a team. The pitcher is also the one who is constantly watched by the fans. Accuracy in pitching is a must and requires considerable practice to achieve the skill necessary to perform successfully as a pitcher Most pitchers do not have a catcher constantly available to allow them the amount of time required to develop and maintain a high level of expertise. While some other pitching targets have been developed to provide pitchers an opportunity to practice they often fall short of optimum effectiveness because some do not provide instant feedback about the exact location of the pitch, others are overly complex and expensive, and none provide the actual feel of pitching to a catcher because of the premium and realistic sound effect caused by the impact of the ball into the leather target. U.S. Pat. No. 5,573,240 issued Nov. 12, 1996 to Humboldt, discloses a baseball backstop for stopping baseballs thrown at the backstop and for audibly indicating whether a thrown ball has hit the backstop in a strike zone comprises a frame, a netting attached to the frame, a piece of material placed directly in front of the netting and attached to the netting and/or the frame, the piece of material is a relatively heavy deformable piece of material, such that when a thrown ball hits the piece of material, a popping or thumping noise is made by the ball hitting the piece of material indicating that the thrown ball is a "strike", the thrown ball is stopped by the piece of material and falls to the ground in an area proximate to the frame for easy retrieval of the thrown ball, the netting is made of a meshed material such that when a thrown ball hits the netting alone, and not the piece of material, no popping or thumping noise is made indicating that the thrown ball is a "ball" and the thrown ball is stopped by the netting and falls to the ground in an area proximate to the frame for easy retrieval of the thrown ball.

U.S. Pat. No. 4,497,485 issued Feb. 5, 1985 to Macosko, shows a baseball pitching target comprising a rectangular peripheral tubular frame supported by support members staked to the ground and having a mesh backstop itself having an insert that represents such target indicia as the catcher's chest protector, shoulder pads and knee protector pads and mitt. Pitched balls are collected in a compartmentalized ball receiving bag except for those pitched balls that miss the strike zone. Those missing the strike zone will be projected back toward the pitcher by the action of the spring-mesh structure of the backstop.

U.S. Pat. No. 4,344,621 issued Aug. 17, 1982 to Baker, shows a practice device for use in the practice of those sports involving the hurling or striking of a ball or other sport projectile toward a specified target. The device of the invention serves to safely arrest the flight of the projectile while informing the user of the exact point of impact of the projectile relative to a defined target zone. The target is a polymeric foam mat having a polymeric sheet bonded to its front face. The sheet removably carries target indicia. Apertures through the foam mat make up 40 to 50 percent of the total surface area of the mat. When a projectile strikes the sheet, an indentation, which lasts from 5 to 60 seconds, indicates the point of impact.

U.S. Pat. No. 4,275,883 issued Jun. 30, 1981 to Grimaldi, et al., is for a pitching target with ball return which indicates whether a baseball pitch is either a strike or a ball and, if a strike, the location of the strike, i.e.: outside corner. The ball return includes an inclined ball collecting trough for return of the thrown ball to the pitcher for reuse. The target includes a frame which supports a series of flap panels suspended in the same plane and within the frame. The panels are arranged in three rows and three columns. The panels in the central column are wider in the horizontal dimension than the two outside panels but have the same vertical dimension as the panels on each side thereof.

U.S. Pat. No. 3,001,790 issued Sep. 26, 1961 to Pratt, claims an improved target for baseball and softball pitchers that allows ball to rebound in manner expected of a batted ball according to the whether the pitch is high, low, inside, outside or in the center. It provides an average strike zone that includes a planar portion centrally of the target and is bounded by rearwardly inclined border portions or panels.

U.S. Pat. No. 4,254,952 issued Mar. 10, 1981 to Playter, shows a pitching practice device consisting of a sheet of canvas or the like supported in a vertical plane, and having an aperture formed therein defining a strike zone, at which a baseball pitcher may pitch baseballs to develop his accuracy and control. For still greater accuracy of control, and to "catch" the balls, a canvas chute is attached to the rearward surface of the sheet, and divided into a plurality of sections each opening through the sheet aperture, for receiving and trapping any ball entering its opening. The sheet aperture is thus divided into zones for indicating, and recording, whether a pitched ball is "high", "low", "inside", "outside", or "down the middle". The sheet is resiliently supported to prevent damage either to the device or to the ball. The device may also be adapted for use, with a set of playing rules, as a competitive game, particularly for children.

U.S. Pat. No. 1,567,384, issued Dec. 29, 1925 to Rectenwald, is for a pitching target that tilts to rebound the ball at different angles. It mentions a resilient portion of the strike zone target, which may be sandwiched behind a panel or on the front surface. Canvas may be stretched over the target strike zone and a coating of calcimine or other material covering the strike zone so that the point of contact of the ball would be visible.

U.S. Pat. No. 5,439,211 issued Aug. 8, 1995 to Drabowsky, indicates a target training system and method for baseball pitchers employing a target sheet mounted on a supporting structure so that a facing surface of the target sheet is vertical and a bottom of the target sheet is at ground level. Hitter shoulder level, waist level, and knee level lines are provided on the facing surface of the target sheet. First and second vertical boundary lines running from a top to a bottom of the sheet indicate a width of a strike zone. A plurality of boxes of differing colors and having differing sequencing indicia representing relatively high quality pitches are arranged in and around the strike zone. Regions having a white color within and near the strike zone and exclusive of the colored boxes are provided, the regions being exclusionary zones representing relatively poor quality pitches. Some of the boxes are subdivided to permit pitching to progressively smaller targets. Separate target sheets are provided for different skill levels.

U.S. Pat. No. 5,672,125 issued Sep. 30, 1997 to Ross, shows a pitcher's practice cage consisting of a compactly-foldable fabric-covered tubular structure which provides a large ball-gathering area, within which hangs a target marked with areas whose striking "calls" the pitch, and a ball-collecting sloping back wall and floor which accumulates pitched balls. Bows which support the canvas cover, one bow rigidly-mounted on short left-and-right support members hinge-mounted closely adjacent to the bow so rigidly supported, permit the entire structure to be folded into a flat "package" for moving and storing.

U.S. Pat. No. 5,222,731 issued Jun. 29, 1993 to Hanabusa, claims a device for catching a ball comprising a frame member constructed on the ground or the like, a net member put on the frame member, a mat member disposed substantially at the central part of the net member, the mat member having a strike zone defined thereon, a detection means for detecting the position of a pitched ball in the strike zone, and a display means for displaying the detected position of the ball. When the pitched ball collides with or passes through the strike zone, the detection means detects the colliding or passing position and has a judgment passed on the pitched ball as to whether it is a strike or ball in accordance with a baseball rule, and the judgment is displayed by the display means. Some devices for catching a ball further comprise a base member permitting the total weight of the device to be arbitrarily varied with a ballast such as water, sand, steel ball or the like, a pitch target shiftable after every pitch, and/or a ball return system for automatically returning the pitched ball to the pitcher.

What is needed is an inexpensive yet effective way to simulate the realistic and dynamic sound effect of pitching into a catcher's mitt with a clear indication of premium areas related to the strike zone and with instant feedback on the precise location of each pitch.

SUMMARY OF THE INVENTION

An object of the present invention is to provide a baseball pitching target with a combination of the leather catcher's glove impact sound with a strike zone target that has a soft backing to allow an impression in the target where the ball hits.

A related object of the present invention is to provide a multi-layer pitching target with a back layer of 18 oz. coated vinyl, canvas or other durable material, a middle layer of cotton or other stuffing material and a front layer of rugged cowhide or other leather so that the padded leather catcher's mitt material is simulated over the entire surface of the target so that wherever the ball hits within the target, the sound of the ball hitting a catcher's mitt is simulated.

Another related object of the present invention is to provide a pitching target with somewhat resilient but tough leather so that, in combination with the soft padding behind the leather, the leather will be indented where the ball hits to provide an instant feedback to the pitcher about the accuracy and quality of the pitch.

Another object of the present invention is quilt-like stitching every six inches used for holding the three layers together securely. The quilt-like stitching provides the basis for the block U-shaped indicia.

Another object of the present invention is the block U-shaped area that defines the premium strike zone locations for a pitch to be delivered. An offset color defines the block U and is used to help pitchers throw the baseball to premium locations within the strike zone.

An additional object of the present invention is the 6" sewing seams that hold the cotton in place and create a grid that breaks the target down into smaller focus zones in order to teach the pitcher to concentrate on hitting a smaller zone within or just outside of the strike zone.

An additional object of the present invention is the concept that due to the padding and grid pattern, the force of each impact "blows" out the last impression and creates the new impression at the latest impact location. This allows the pitcher to accurately determine where his last pitch impacted the target and not be confused by previous impressions.

A further object of the present invention is the marked squares for the inner third, outer third, and lower section of the strike zone to develop precision accuracy in pitching to premium locations of the strike zone. Because the premium areas of the strike zone consist of the outer left and right sides of the strike zone as well as the lower area, the darkened squares mark these areas to help pitchers increase their accuracy in these premium locations. This allows pitchers to practice pitching to the premium areas of the strike zone or to just outside the strike zone when in pitcher-advantage counts.

A contributory object of the present invention is to use straps or ropes to make the invention easy to hang on existing padded backing structures to retain a ball if it misses the target, or on a frame with netting created for use with the pitching target.

One more object of the present invention is to provide flexible lightweight materials so that the invention is easily folded up and transported.

In brief, a leather pitching target is designed to retain precise impact location of every pitch with the dynamic sound effect of throwing into a catcher's mitt. A block U colored shape defines the optimal strike zone locations for a pitcher to hit. This unique pitching tool is fun and effective in teaching a pitcher to improve pitching in and just outside of the strike zone. An impression of the precise pitch impact location gives the pitcher instant feedback on the quality of the pitch. Not even a catcher or an umpire can consistently determine exact location of every pitch as it crosses the plate as well as the present invention.

A 27"×33" cotton pad behind the leather face creates a quilting effect for the target. This allows the target to retain precise ball impact location. Each pitch creates an impression or indentation in the target at the precise impact location. The force of each impact "blows" out the last impression and creates the new impression at the latest impact location. This is critical because otherwise it would be difficult to tell one impression from another after hundreds of impacts.

An advantage of the present invention is that the pitcher knows the exact location of each pitch both inside and outside of the strike zone Another advantage of the present invention is that it simulates the sound of the ball hitting a catcher's mitt. This is a sound that a pitcher loves to hear and no other pitching target available provides this realistic and dynamic sound effect.

An additional advantage of the present invention is that it helps pitchers throw the baseball more accurately in premium locations of the strike zone.

Yet another advantage of the present invention is that it teaches the pitcher to concentrate on hitting a smaller zone within the strike zone.

Still another advantage of the present invention is that each new impression at the latest impact location eradicates the previous impression allowing the pitcher to accurately determine where his last pitch hit the target and not be confused by previous impressions.

Another advantage of the present invention is that it allows pitchers to practice throwing in the areas of the strike zone that are more difficult for a batter to hit.

A further advantage of the present invention is that it may be easily hung on existing padded backing structures to retain a ball if it misses the target or on a frame with netting created for use with the pitching target.

One more advantage is the relatively light weight of the invention as well as the ability for it to be easily folded up and transported

BRIEF DESCRIPTION OF THE DRAWINGS

These and other details of my invention will be described in connection with the accompanying drawings, which are furnished only by way of illustration and not in limitation of the invention, and in which drawings.

BEST MODE FOR CARRYING OUT THE INVENTION

Figure 1:
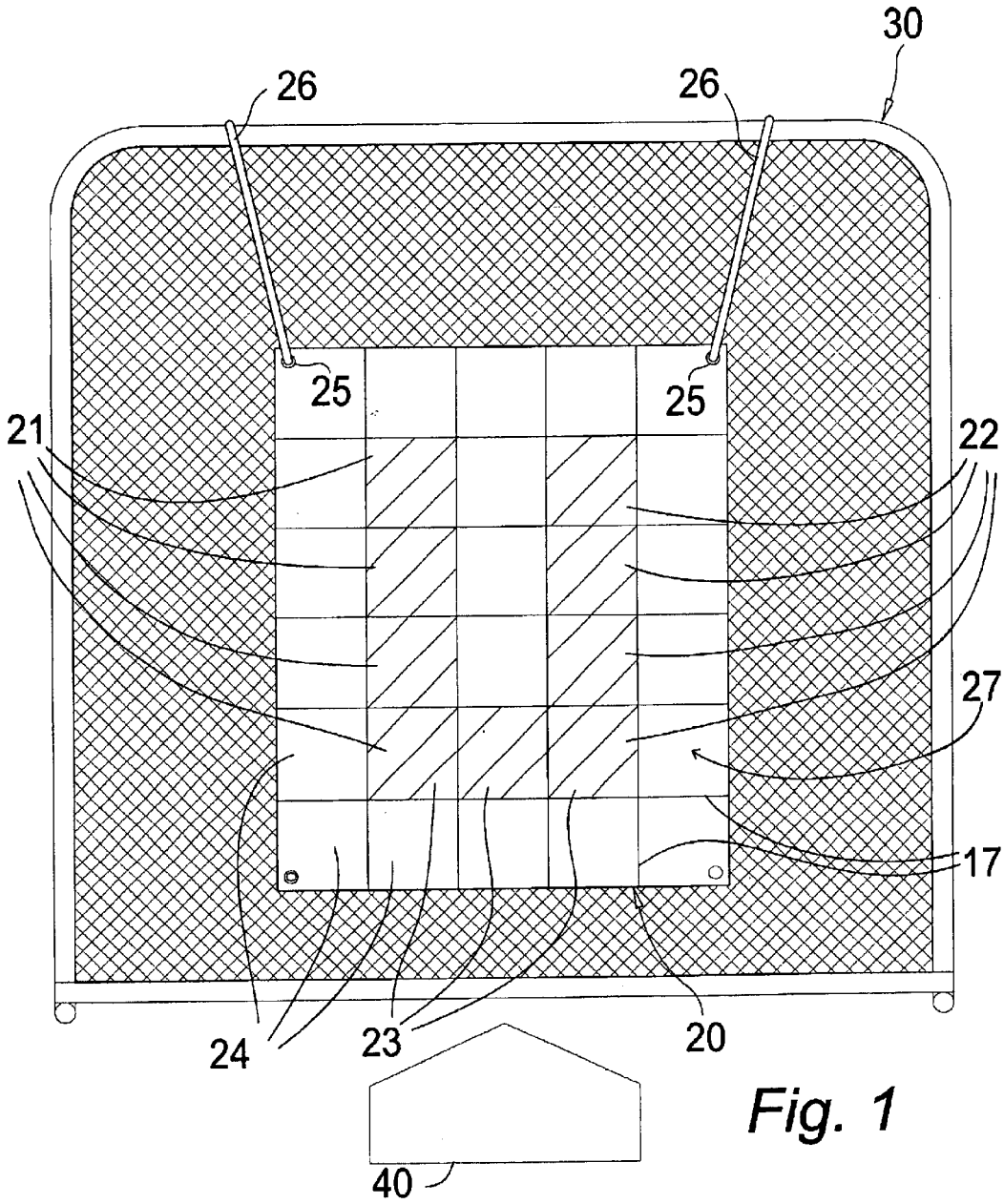
FIG. 1 is a front elevational view of the baseball pitching target mounted on a netted frame.
Figure 2:
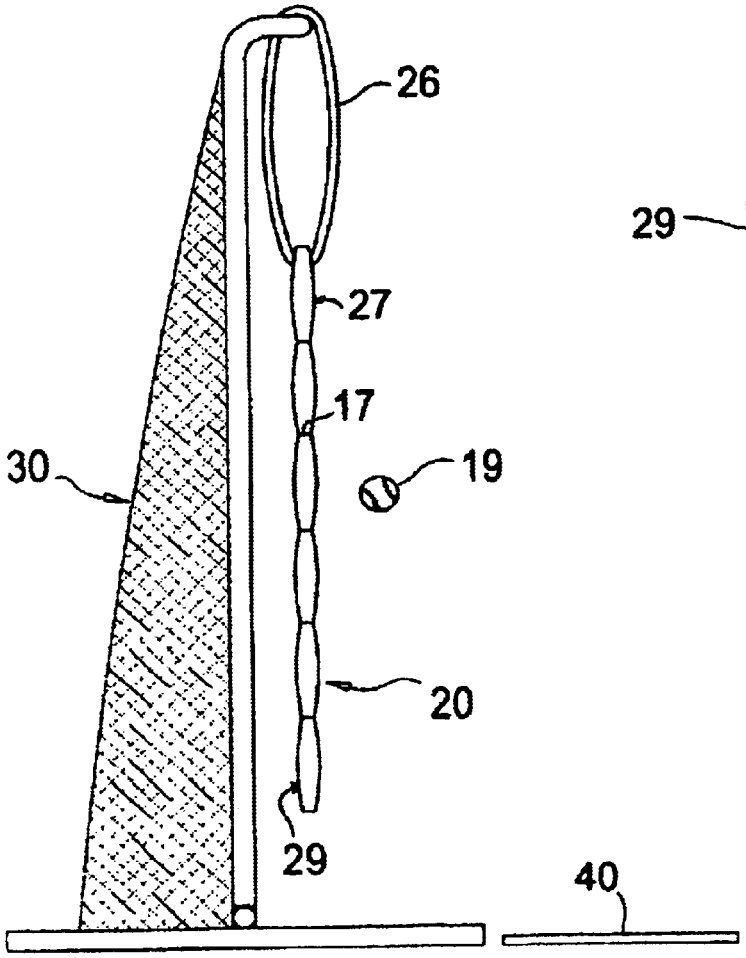
FIG. 2 is a side elevational view of the baseball pitching target of FIG. 1 mounted on a netted frame.
Figure 3:
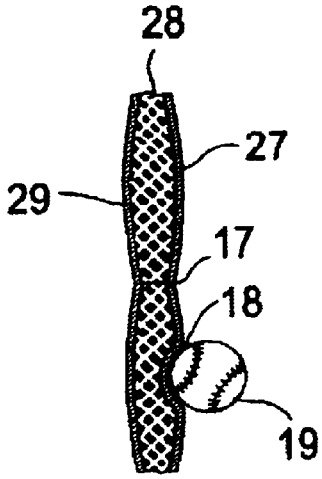
FIG. 3 is a cross-sectional view of a portion of the baseball pitching target of FIG. 1 showing the indentation made by a baseball pitched at the target.

In FIGS. 1–3, a baseball pitching target 20 produces the sound of a baseball hitting a catcher's mitt to provide a realistic environment for the pitcher. The target may comprise a single layer of leather 27 formed with the strike zone 21, 22, and 23 indicated thereon. The preferred embodiment shows the leather or cowhide front target layer 27 in combination with the padded middle layer 28 allows for this sound as well as to provide an indentation 18, as seen in FIG. 3, for an instant visual feedback of where the ball strikes in order to allow the pitcher to improve accuracy. The target comprises three layers of material as seen in FIG. 3. The back layer 29 consists of durable sheet material such as 18 oz. coated vinyl or canvas. The front or target layer 27 is fabricated out of resilient leather and bears visual indicia 21, 22, and 23 defining a baseball strike zone. The middle layer 28 is comprised of resilient padding material capable of being compressed and of expanding after being compressed, so that a first pitched ball 19 striking the leather target layer 27 makes a sound of a ball striking a leather padded catcher's mitt. The back layer 29 and front target layer 27 are stitched together tightly around the periphery so that the middle padding layer 28 is inside a relatively air-tight space so that air movement in one part of the space affects the other parts of the space. The padding is preferably a compressible resilient fiber interspersed with air spaces, such as cotton padding or a synthetic fill material, so that it is compressible. The first pitched ball 19 then creates a first visible indentation 18 of the target layer 27 and a first compression of the padded layer 28 at the point of impact where the ball 19 hits the target layer 27, as seen in FIG. 3. The middle padded layer 28 is also expandable, so that a second pitched ball striking the target and creating a second indentation of the target layer and a second compression of the middle layer forces air to rush out of the second indentation. This action creates air movement within the air space, which causes the padded layer to puff out and expand, then to smooth out the first indention of the target layer at the point of impact of the first pitched ball so that only the second indentation of the target layer is visible.

In FIG. 1, the baseball pitching target 20 has visual indicia 21, 22, and 23 on the target layer which comprises visually contrasting portions of the target layer and which defines at least three different areas 21, 22, and 23 within the strike zone. On the front of the target layer, the contrasting portions comprise a block U-shaped area defining an inside third of the strike zone 22 for a right-handed batter, an outside third of the strike zone 21 for a right-handed batter, and the bottom section of the strike zone 23.For a left-handed batter, the inside and outside thirds would be reversed. These zones represent areas where it is more difficult for a batter to hit the ball and are thus desirable areas within which to pitch the ball.

There is a quilt-like pattern of stitching 17 between the three layers, and over the entire surface of the baseball pitching target 20, to securely hold the layers together. The quilt-like pattern of stitching 17 is comprised of rectangular shapes, preferably squares, some of which squares have a different visual coloration of the target layer 27 to form the visual indicia 21, 22 and 23 which are components of the block U-shaped strike zone. One column of four squares forms the inside third of the strike zone 22 for a right-handed batter, one column of four squares forms the outside third of the strike zone 21 for a right-handed batter, and one row of three squares forms the bottom section of the strike zone 23. The squares delineate smaller portions of the strike zone that can be used as specific targets within and around the strike zone. The stitching 17 is preferably every six inches in a horizontal direction and every six inches in a vertical direction to create a pattern of squares over the surface of the baseball pitching target 20 including the strike zone indicia squares 21, 22, and 23 and the border squares 24 around the strike zone.

The baseball pitching target further comprises a means for hanging the baseball pitching target preferably grommets 25 at the four corners and straps 26. Additionally, a home plate 40 may be positioned on the ground in front of the target.

The preferred dimensions for the invention are as follows: The leather front target layer 27 measures 30"×36", followed by a single piece cotton padding center layer 28 measuring 27"×33". The center padding calculates to be 3" shorter in width and length in order to provide a tightly pressed outside edge. The center padding is followed by a coated vinyl fabric or durable canvas backing layer 29 measuring 30"×36".

In manufacturing the baseball pitching target, the three layers are sewn together preferably with strong industrial stitching 17 in a 61' grid pattern to create the desired effect. Next, the grommets 25 are installed in the four corners of the target to allow for attachment/suspension by straps or ropes 26 to a netted screen 30 or other support structure.

Another embodiment of the present invention could consist of a coated vinyl fabric or canvas front that would be more affordable. This product will have all of the novel attributes of the original design with the exception of the leather sound effect.

In practice, the pitcher stands in front of the target and practices pitching to improve arm strength and control. The pitcher practices pitching to different areas 21, 22, and 23 of the strike zone and specific squares within the strike zone as well as pitching into the squares 24 just outside the strike zone. Each pitch forms an indentation and removes the previous indentation so that the pitcher can see exactly where each pitched ball impacts the pitching target 20. Also, a pitcher can begin by standing at a close distance from the target and, as accuracy increases, increase the distance from the target until reaching the official distance.

It is understood that the preceding description is given merely by way of illustration and not in limitation of the invention and that various modifications may be made thereto without departing from the spirit of the invention as claimed.

What is claimed is:

1. A baseball pitching target for producing a sound of a baseball hitting a catcher's mitt and for providing an instant feedback visual indication of where the ball impacts the target, the baseball pitching target comprising:

a target fabricated of resilient leather so that a pitched ball striking the target makes a sound of a ball striking a leather catcher's mitt, the target having at least a portion of the target defining a baseball strike zone, the target indents to form a first visible indentation at a point of impact of a first pitched ball striking the target and the target being capable of having the first visible indentation being leveled out in response to a second pitched ball striking the target at a second point of impact forming a second visible indentation of the target; and a means for maintaining the target in an upright positions;

a padded layer behind the target:

a backing layer attached to the target sandwiching the padding between the target and the backing layer, the target and the backing layer being interconnected around a matching perimeter to form an air space therebetween so that the second pitched ball striking the target causes air movement within the air space to contribute to the first visible indentation being leveled out.

2. The baseball pitching target of claim 1 wherein the padding comprises a resilient fiber interspersed with air spaces.

3. The baseball pitching target of claim 2 wherein the target hangs vertically and the stitching is every six inches in a horizontal direction and every six inches in a vertical direction to create a pattern of squares over the surface of the baseball pitching target so that one column of four squares forms the inside third of the strike zone, one column of four squares forms the outside third of the strike zone, and one row of three squares forms the bottom section of the strike zone.

4. The baseball pitching target of claim 3 wherein the visually contrasting portion of the target layer comprises a block U-shaped area defining the premium areas within the strike zone including an inside third of the strike zone, an outside third of the strike zone, and a bottom section of the strike zone.

5. The baseball pitching target of claim 1 wherein said at least a portion of the target defining a baseball strike zone comprises a visually contrasting portion of the target comprising a block U-shaped area defining the premium areas within the strike zone including an inside third of the strike zone, an outside third of the strike zone, and a bottom section of the strike zone, and wherein the target and backing layer are interconnected by stitching and the stitching forms a pattern which is comprised of rectangular shapes some of which form components of the strike zone and delineate smaller portions of the strike zone which can be used as specific targets within and around the strike zone.

6. The baseball pitching target of claim 1 wherein said at least a portion of the target defining a baseball strike zone comprises a visually contrasting portion of the target layer that defines premium areas within the strike zone.

7. A baseball pitching target for producing a sound of a baseball hitting a catcher's mitt and for providing an instant feedback visual indication of where the ball impacts the target, the baseball pitching target comprising:

a backing layer of durable sheet material;

a target layer fabricated of resilient leather having at least a portion of the target defining a baseball strike zone, the target layer and the backing layer being interconnected around a matching perimeter of the two layers to form an air space therebetween;

a padding layer sandwiched between the backing layer and the target layer in the air space therebetween, the padding layer formed of resilient padding material that compresses and expands after being compressed so that a first pitched ball striking the target layer makes a sound of a ball striking a leather padded catcher's mitt, the first pitched ball causing a first indentation of the target layer and a first compression of the padding layer at the point of impact to form a first visible indentation in the target and a second pitched ball striking the target causing air movement within the air space to cause expansion of the padded layer at the point of impact of the first pitched ball causing a leveling out of the first indentation and at the same time causing a second indentation of the target layer and a second compression of the padding layer at the point of impact of the second pitched ball to form a second visible indentation;

a pattern of stitching between the three layers to hold the three layers together over the entire surface of the baseball pitching target, and a means for maintaining the target in an upright position.

8. The baseball pitching target of claim 7 wherein the resilient padding material comprises a resilient fiber interspersed with air spaces.

9. The baseball pitching target of claim 7 wherein said at least a portion of the target defining a baseball strike zone comprises a visually contrasting portion of the target layer that defines premium areas within the strike zone.

10. The baseball pitching target of claim 9 wherein the visually contrasting portion of the target layer comprises a block U-shaped area defining the premium areas within the strike zone including an inside third of the strike zone, an outside third of the strike zone, and a bottom section of the strike zone.

11. The baseball pitching target of claim 10 wherein the target layer and backing layer are interconnected by stitching and the stitching forms a pattern which is comprised of rectangular shapes some of which form components of the strike zone and delineate smaller portions of the strike zone which can be used as specific targets within and around the strike zone.

12. The baseball pitching target of claim 11 wherein the target hangs vertically and the stitching is every six inches in a horizontal direction and every six inches in a vertical direction to create a pattern of squares over the surface of the baseball pitching target so that one column of four squares forms the inside third of the strike zone, one column of four squares forms the outside third of the strike zone, and one row of three squares forms the bottom section of the strike zone.

* * * * *